US007607396B2

(12) United States Patent
Saxton et al.

(10) Patent No.: US 7,607,396 B2
(45) Date of Patent: Oct. 27, 2009

(54) CONTAINER CAR SIDE SILLS

(75) Inventors: Gregory J. Saxton, Portland, OR (US); Elijah A. Schutz, Portland, OR (US); Ryan M. Geary, Portland, OR (US)

(73) Assignee: Gunderson LLC, Portland, OR (US)

( * ) Notice: Subject to any disclaimer, the term of this patent is extended or adjusted under 35 U.S.C. 154(b) by 169 days.

(21) Appl. No.: 11/985,400

(22) Filed: Nov. 14, 2007

(65) Prior Publication Data

US 2009/0120324 A1 May 14, 2009

(51) Int. Cl.
*B61D 17/00* (2006.01)

(52) U.S. Cl. ..... 105/404; 105/355; 105/418

(58) Field of Classification Search ..... 105/416, 105/417, 418, 419, 355, 396, 397, 399, 400, 105/401, 404, 411, 413, 414, 409; 52/831, 52/836, 837, 839, 842, 843, 846
See application file for complete search history.

(56) References Cited

U.S. PATENT DOCUMENTS

| | | | |
|---|---|---|---|
| 717,488 | A | 5/1903 | Swanson |
| 1,085,196 | A | 1/1914 | Downing |
| 1,110,394 | A | 9/1914 | Lindall |
| 1,114,552 | A | 10/1914 | Taurman |
| 1,168,335 | A | 1/1916 | Rowntree |
| 1,617,658 | A | 2/1927 | Suarez |
| 1,634,490 | A | 7/1927 | Collis |
| 1,696,332 | A | 12/1928 | Sheehan |
| 1,699,520 | A | 1/1929 | Gibbs et al. |
| 1,699,529 | A | 1/1929 | Gibbs et al. |
| 1,875,584 | A | 9/1932 | Frede et al. |
| 1,889,605 | A | 11/1932 | Jones |
| 2,052,213 | A | 8/1936 | Branstrator |
| 2,194,356 | A | 3/1940 | Eklund |
| 2,255,900 | A | 9/1941 | Schlessinger |
| 2,278,554 | A | 4/1942 | Morton |
| 2,279,756 | A | 4/1942 | Lieberman |
| 2,327,585 | A | 8/1943 | Ulrich |
| 2,401,401 | A | 6/1946 | Bartsch |
| 2,504,112 | A | 4/1950 | Dean et al. |
| 3,102,613 | A | 9/1963 | Johnston |

(Continued)

FOREIGN PATENT DOCUMENTS

| | | |
|---|---|---|
| DE | 3711409 | 10/1987 |

(Continued)

OTHER PUBLICATIONS

U.S. Appl. No. 12/221,089, filed Jul. 30, 2008, Saxton, et al.

*Primary Examiner*—Mark T Le
(74) *Attorney, Agent, or Firm*—Chernoff, Vilhauer, McClung & Stenzel, LLP

(57) ABSTRACT

A railroad freight car that may include multiple units, the body of at least one unit including a container well for carrying intermodal freight containers, the body including a pair of side sills generally of closed box beam configuration with holes and reinforcing rings and with longitudinally extending reinforcing members in the top or bottom, or both, of the beams. The ends of the longitudinally extending reinforcing members are tapered and have their extremities attached to a portion of a side sill web spaced apart from the extreme top or bottom members of the beam.

12 Claims, 4 Drawing Sheets

U.S. PATENT DOCUMENTS 3,152,667 A 10/1964 Johnston
3,152,669 A 10/1964 Johnston
3,181,440 A 5/1965 Mullaney et al.
3,290,058 A 12/1966 Ellerd
3,308,769 A 3/1967 Halcomb et al.
3,319,583 A 5/1967 Gutridge
3,357,371 A 12/1967 Gutridge
3,389,663 A 6/1968 Gutridge
3,420,192 A 1/1969 Ellis
3,520,256 A 7/1970 Gutridge
3,616,764 A 11/1971 Johnson et al.
3,645,213 A 2/1972 Taylor
3,659,724 A 5/1972 Miller et al.
3,731,967 A 5/1973 Hughes
3,818,843 A 6/1974 Lee
3,981,548 A 9/1976 MacDonnell et al.
4,064,947 A 12/1977 Cole
4,091,742 A 5/1978 Cordani
4,150,628 A 4/1979 Keldenich
4,179,997 A 12/1979 Kirwan
4,191,107 A 3/1980 Ferris et al.
4,233,909 A 11/1980 Adams et al.
4,274,776 A 6/1981 Paton et al.
4,288,957 A 9/1981 Meehan
4,331,083 A 5/1982 Landregan et al.
4,408,810 A 10/1983 Geyer
4,428,296 A 1/1984 Scheuchzer et al.
4,452,147 A 6/1984 Jwuc
4,456,413 A 6/1984 Pavlick
4,524,699 A 6/1985 Pavlick
4,563,957 A 1/1986 Billingsley et al.
4,597,337 A 7/1986 Willetts
4,599,949 A * 7/1986 Hill ..... 105/355
4,624,188 A 11/1986 Kaleta
4,671,714 A 6/1987 Bennett
4,686,907 A 8/1987 Woollam et al.
4,703,699 A 11/1987 Hill
4,718,353 A 1/1988 Schuller et al.
4,741,273 A 5/1988 Sherwood
4,750,431 A 6/1988 Yates et al.
4,751,882 A 6/1988 Wheatley et al.
4,754,709 A 7/1988 Gramse et al.
4,771,706 A 9/1988 Lindauer et al.
4,782,762 A * 11/1988 Johnstone et al. ..... 105/355
4,792,269 A 12/1988 Engle
4,798,148 A 1/1989 Girard
4,802,420 A 2/1989 Butcher et al.
4,805,539 A 2/1989 Ferris et al.
4,807,722 A 2/1989 Jamrozy et al.
4,841,876 A * 6/1989 Gramse et al. ..... 105/406.1
4,862,810 A 9/1989 Jamrozy et al.
4,864,938 A 9/1989 Hesch et al.
4,876,968 A 10/1989 Lindauer et al.
4,889,055 A * 12/1989 Jamrozy et al. ..... 105/355
4,893,567 A 1/1990 Hill et al.
4,901,649 A 2/1990 Fehrenbach et al.
4,905,608 A * 3/1990 Terlecky et al. ..... 105/355
4,909,157 A 3/1990 Jamrozy et al.
4,911,082 A 3/1990 Richmond
4,929,132 A 5/1990 Yeates et al.
4,947,760 A 8/1990 Dawson et al.
4,949,646 A 8/1990 Jamrozy et al.
4,951,575 A 8/1990 Dominguez et al.
4,955,144 A 9/1990 Lienard et al.
4,966,082 A 10/1990 Takeichi et al.
5,001,990 A 3/1991 Pavlick
5,017,064 A 5/1991 Kirwan et al.
5,020,445 A 6/1991 Adams, Jr.
5,054,403 A 10/1991 Hill et al.
5,085,152 A * 2/1992 Tylisz et al. ..... 105/419
5,090,331 A 2/1992 Hesch et al.
5,170,718 A 12/1992 Hill et al.
5,197,392 A 3/1993 Jeunehomme
5,207,161 A 5/1993 Pileggi et al.
5,216,956 A 6/1993 Adams, Jr.
5,246,321 A 9/1993 Hesch
5,279,230 A 1/1994 Thomas et al.
5,372,073 A 12/1994 Cattani
5,407,309 A 4/1995 Hesch et al.
5,423,269 A 6/1995 Saxton et al.
5,452,664 A 9/1995 Richmond
5,465,670 A 11/1995 Butcher
5,501,556 A 3/1996 Butcher
5,511,491 A 4/1996 Hesch et al.
5,520,489 A 5/1996 Butcher et al.
5,562,046 A * 10/1996 Fetterman et al. ..... 105/419
5,611,285 A * 3/1997 Saxton ..... 105/355
5,626,083 A 5/1997 Saxton
5,657,698 A 8/1997 Black, Jr. et al.
5,730,063 A 3/1998 Forbes et al.
5,743,191 A 4/1998 Coslovi
5,749,686 A 5/1998 Butcher et al.
6,003,445 A 12/1999 Coslovi et al.
6,095,055 A 8/2000 Lohr et al.
6,196,137 B1 3/2001 Forbes
6,199,486 B1 3/2001 Landrum et al.
6,357,363 B1 3/2002 Militaru
6,505,564 B2 11/2002 Khattab
6,510,800 B1 1/2003 Zaerr et al.
6,546,878 B1 4/2003 Smith et al.
6,584,912 B2 7/2003 Forbes
6,704,991 B1 * 3/2004 Coulborn et al. ..... 29/525.14
2007/0261593 A1 11/2007 Saxton

FOREIGN PATENT DOCUMENTS

EP 0510372 10/1992
EP 0510467 10/1992

* cited by examiner

CONTAINER CAR SIDE SILLS

BACKGROUND OF THE INVENTION

The present invention relates to railroad freight cars, and in particular to the structure of a car intended to carry intermodal freight containers in a container well.

Railroad cars have been used to carry intermodal freight containers for decades. Many such cars can carry a pair of short containers end-to-end in a container well defined by a pair of spaced-apart side sills, as shown, for example, in Hill, et al., U.S. Pat. Nos. 4,893,567, 5,054,403, and 5,170,718; Hill, U.S. Pat. Nos. 4,599,949 and 4,703,699; Tylisz, et al., U.S. Pat. No. 5,085,152; Zaerr, et al., U.S. Pat. No. 6,510,800; and Smith, et al., U.S. Pat. No. 6,546,878. While such cars must be built sufficiently strong to support the weight of loaded containers, as well as being capable of sustaining the forces imposed on a car during operation of a railroad train, it is desirable to minimize the weight of each car itself, so that it can carry a greater weight of revenue producing laden containers without exceeding the maximum weight permitted to be imposed on a railroad track.

In such container well cars side sills serve both as side walls of a container well and to carry the many dynamic forces imposed by movement of the car as part of a train. The side sills also have to carry the bending loads resulting from the weight of containers carried in the well or stacked atop a container or a pair of containers carried in the well. A pair of short containers carried end-to-end in the well impose part of their weight on the side sills near the middle of the length of the container well. The side sills must thus be able to sustain the weight of the adjacent ends of a pair of short containers located in the middle of the length of the container well.

Because of the overall size limitations within which a loaded railway car must fit, as a result of the clearances along a railway and the configuration of conventional side-loading equipment available for loading containers onto railroad cars, only a limited space is available within which the side sill structures of a container-carrying railroad freight car may be constructed. Nevertheless, the side sills must have sufficient strength to support the vertical beam loads applied when the car is laden, and to resist torsional and axial stresses resulting from the loads applied during travel of a laden car, while the weight of the side sill structures should be kept to a minimum consistent with the required strength.

Since cargo containers are placed between the side sills of a well car, structural interconnection between the top edges of the side sills is prevented, and each side sill must have sufficient torsional rigidity to prevent structural failure when such a well car is laden. This is particularly true when two shorter containers, such as 20-foot containers, are carried end-to-end in a container well of such a car, applying substantial vertical loading midway between the supporting trucks of the car.

SUMMARY

According to the present disclosure, a railroad freight car, defined by the claims which are appended hereto, is provided in which to carry a pair of freight containers of greater weight than could previously be carried end-to-end in a container well of a car of similar weight, with a container well car side sill structure only slightly greater in weight than was previously needed to carry a significantly lighter lading.

In one embodiment of a container-carrying railroad freight car, lightweight but strong side sills include a thin metal side plate, to which is welded a channel member of thin metal plate. A web portion of the channel may be vertical, parallel with the side plate, and the combined structure can provide a rigid side sill generally of a box beam form similar to that disclosed, for example, in U.S. Pat. No. 4,703,699, of which the disclosure is hereby incorporated herein by reference. The side sills may be supported by body bolsters of a well known design, such as one similar to that described in U.S. Pat. No. 4,703,699.

Container supporting structures may be supported by the side sills at mid-length of the container well to support the adjacent ends of a pair of short containers carried end-to-end in the container well, such as a pair of containers each 20 feet long. Each side sill may include a reinforcement plate extending along the interior of the box beam and extending longitudinally in each direction from the mid-length portion of the container well. The reinforcement may include vertical and laterally extending portions lying alongside and in contact against interior surfaces of the web and laterally extending flange portions of the channel member at the top and bottom of the side sill, and the vertical portion of the reinforcement extends further from the mid length portion of the side sill toward each end of the side sill than does the laterally extending portion. Extreme end portions of the reinforcement are fastened to the web of the channel member, so that stresses are carried by the reinforcement to portions of the web of the channel member where application of those stresses will not overload the material of the channel member.

The foregoing and other features and advantages of the disclosed car will be more readily understood upon consideration of the following detailed description taken in conjunction with the accompanying drawings.

DETAILED DESCRIPTION OF EMBODIMENTS

Figure 1:
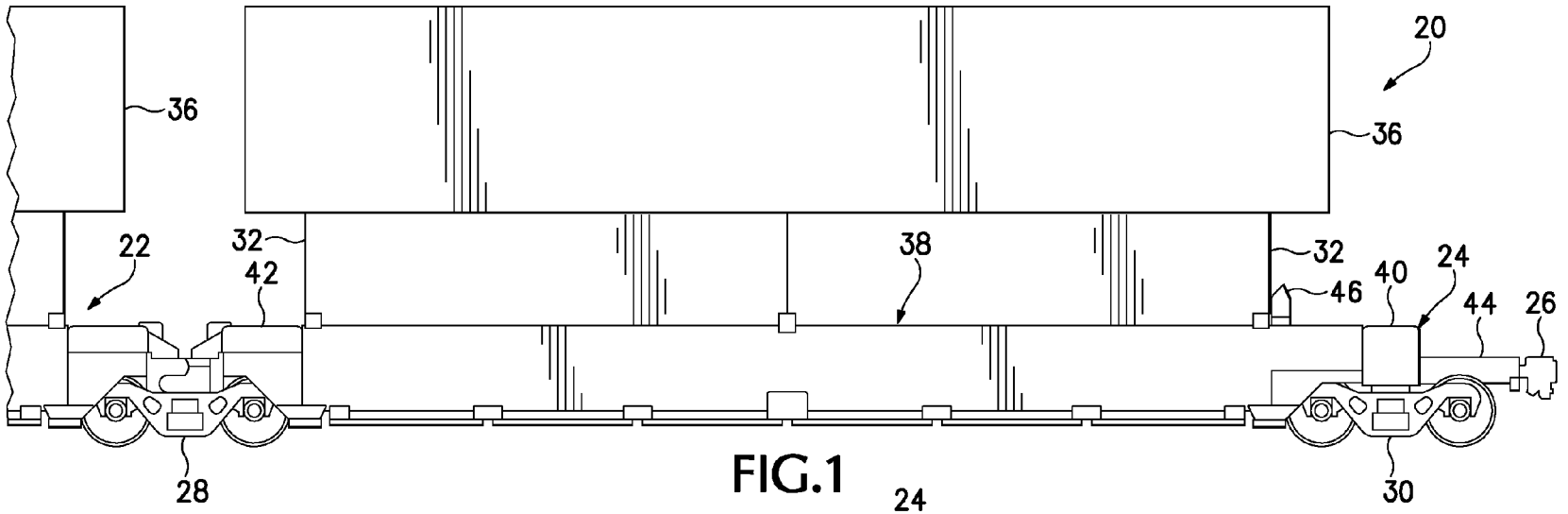
FIG. 1 is a side elevational view of a portion of a multi-unit lightweight container-carrying well car with a pair of short containers in the container well and a longer container carried atop them.

Referring to the drawings which form a part of the disclosure, a lightweight container car 20 may include a single car body with a wheeled truck and a conventional coupler at each end, or may, as shown in FIG. 1, include a plurality of car body units, interconnected with one another by articulating couplers that connect an intermediate car unit 22 to other intermediate car units (not shown) and to two opposite end car units 24 (only one being shown) which have standard railroad couplers 26 to permit the multi-unit container car 20 to be connected to other railroad cars or to a locomotive. The adjacent ends of both of a pair of car units that are coupled together by an articulating coupling are supported on a single four-wheeled truck such as truck 28, while an outer end of each end car unit 24 is supported by a conventional four-wheeled truck 30.

In FIG. 1, a pair of short containers 32 such as nominal 20-foot containers, are shown carried in the container well of the end unit 24 with a pair of adjacent ends of the containers 32 located at mid-length of the container well 34, and a long container 36, for example, a 45-foot container, is carried atop the two short containers 32.

Each end car unit 24 includes a pair of side sills 38 which are rigidly connected to body bolsters 40 and 42. The body bolster 42 is connected to a stub center sill to which one half of an articulating coupling is attached, while the other half of the articulating coupling is attached to an opposite stub center sill of the adjacent intermediate car unit 22. At the opposite outer end of the end car unit 24 the body bolster 40 is rigidly connected to a stub center sill 44 which is connected to the conventional coupler 26.

Each of the units 22 and 24 of the well car 20 includes a container well 34 and at least the end car unit 24 can carry one 40-foot container (not shown) or two or more intermodal freight containers, such as two nominal 20-foot containers 32 within the container well 34 and a 45-foot container 36 stacked atop the 20-foot containers 32 or the 40-foot container.

Figure 2:
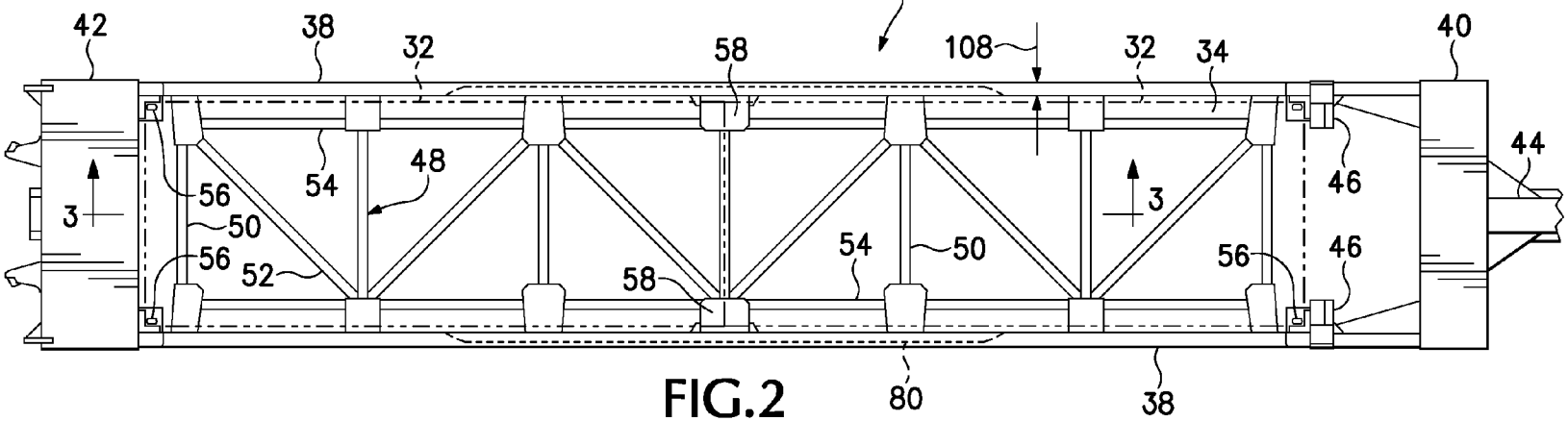
FIG. 2 is a top plan view of an end unit of the multi-unit car shown in FIG. 1.

The container well 34 is defined within each well car unit 22 or 24, as may be seen with respect to the end unit 22 in FIG. 2, by a pair of opposite side sills 38 which act as sides of the container well 34 and extend from the body bolster 40 at the outer, conventional coupler, end to the body bolster 42 at the opposite intermediate end of the container well. Ends of the container well 34 may be defined by the body bolster 42 at the intermediate end of the end unit 24, and by container placement guides 46 mounted on the side sills 38, located at a distance inboard from the body bolster 40 at the outer end to provide room for the wheeled truck 30. Ends of container wells in the intermediate units 22 may be defined by similar body bolsters 42 at each end of each intermediate unit 22.

As best shown in FIG. 2, the lower portions of the two side sills 38 may be connected to each other by a bottom truss assembly 48 that extends horizontally between the side sills 38 at the bottom of the container well 34 to provide lateral support for the bottom of each of the side sills 38 and act as an emergency means of containment for contents of a failed container 32. Beams 50, 52, and 54 of the truss 48 may be attached to the side sills 38 by respective connecting parts, strengthening the resistance of the side sills 38 to lateral deflection and assisting them in resisting buckling.

As illustrated in FIG. 2, four container-supporting feet 56 are rigidly secured to the side sills 38 and provide support for the corners of a 40-foot long by 8-foot (or 8½ foot) wide container. The supporting surfaces of the feet 56 are at an elevation slightly above the beams 50, 52, and 54, as described, for example, in U.S. patent application Ser. No. 11/431,295, filed May 9, 2006. In addition to the corner supporting feet 56, a pair of central container supporting feet 58 may be rigidly secured to the side sills 38 for supporting the adjacent ends of short containers such as the two 20-foot long containers 32 carried in the container well 34 of the end unit 24.

It will be appreciated that the car 20 described above cannot have a center sill because the lower surface of the container must be positioned close to the tracks, below the level of a center sill, to provide room for an upper container 36. The width of the space available for a car side sill 38 is limited by the width of the containers to be carried, usually either 8 feet or 8½ feet, thus defining the inner dimension of the side sills, while the outer dimension is determined by a clearance envelope defined for the car to permit the car to operate on available railroads. The maximum side sill height is determined by conventional side loading equipment for loading containers onto the car, and sufficient clearance beneath the side sills 38 must also be provided.

All of these above-mentioned factors serve to produce a very small envelope into which a side sill must fit; yet it must be of adequate strength. To have strength to resist vertical bending loads, the side sills 38 are made as deep as possible; and to resist localized warping and buckling, a closed section is efficient. As a closed section, for a decrease in weight the thickness of the material of its members must decrease, and as the thickness decreases local warping of the thin members may become a problem. Torsional rigidity is important, as the opposite side sills 38 are connected to one another only by the truss-type framework 48 connecting the bottoms of the side sills. The side sills 38 must therefore be rigid enough to be self-supporting against lateral and torsional stress when the car is fully loaded.

In the embodiment disclosed herein, each side sill 38 includes a generally flat outer plate 60 and a channel member 62 located on an inner side of the flat outer plate 60, that is, on the side of the plate 60 facing laterally inwardly toward the interior of the container well 34. The channel 62 may be constructed of thin flat metal plate bent to include a pair of laterally-extending flanges, a top flange 64 and a lower, or bottom, flange 66, interconnected through bends 67 with a web portion 68 that extends parallel with the flat plate 60. The flat plate 60 and the channel 62 are interconnected securely with each other, as by the outer margins of the flanges 64 and 66 being welded to the plate 60, and also by the web 68 being connected to the plate 60 by connecting members such as stiffening rings in the form of tubes 69 extending between and fastened to both the plate 60 and the web 68 of the channel 62.

To accommodate the tubes 69, the channel 62 may define a plurality of evenly-spaced large holes 70 as shown in the drawings, although the holes 70 could instead be defined in the plate 60. The stiffening rings or tubes 69 effectively prevent local warping and also contribute to section strength to resist bending and torsion. Even though holes 70 are introduced in the web material of the channel member, the tubes 69 added in this area put back more strength into the side sill member than would be present if the material had not been removed to provide the holes 70. The rings or tubes 69 allow construction of a deep, strong side sill with vertical load capabilities, which is able to resist local warping and buckling, and which has sufficient torsional rigidity. An adequate number of the connecting tubes 69 are provided to prevent local buckling movement of the relatively thin plate metal material of which the channel 62 and plate 60 are constructed, so that the side sill 38 consequently has a high load-bearing strength and sufficient torsional rigidity while still being relatively light in weight.

In one embodiment, twelve elliptical holes 70, each having a major axis 72 of about 24 inches and a minor axis 74 of about 20 inches and thus an area of about 377 square inches, are spaced about 30¾ inches apart from one another, center-to-center. Material removed from each hole 70 thus weighs about 36.7 pounds. It will be appreciated that the holes 70 could be of a circular shape, but elliptical tubes may provide the best reduction of weight of the channel. It is not critical that all the holes 70 be of equal size, be equally spaced, or be located in a single straight line for the benefits of this type of structure to be gained.

Figure 3:
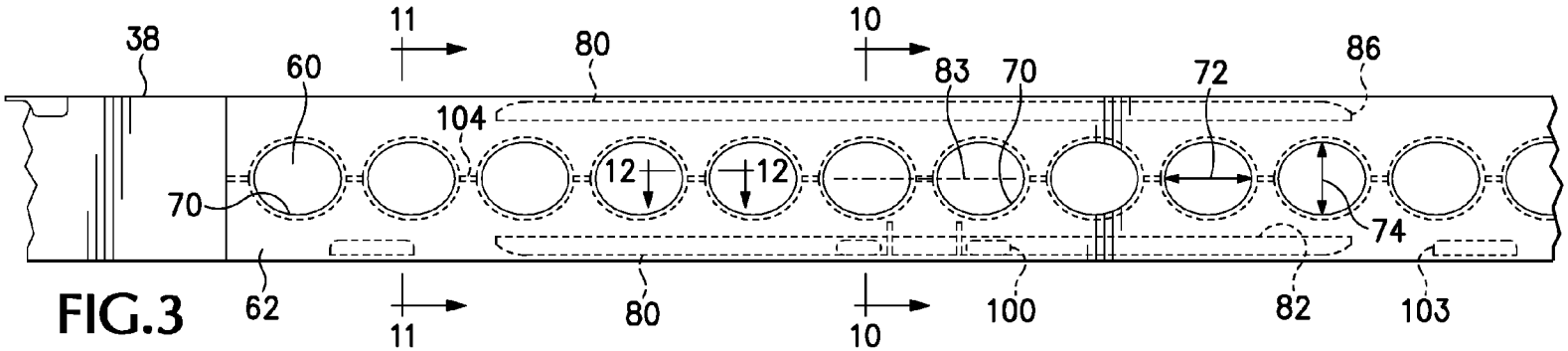
FIG. 3 is a side elevational view of a portion of one side sill of the car unit shown in FIG. 2, taken in the direction indicated by the line 3-3 in FIG. 2.
Figure 4:
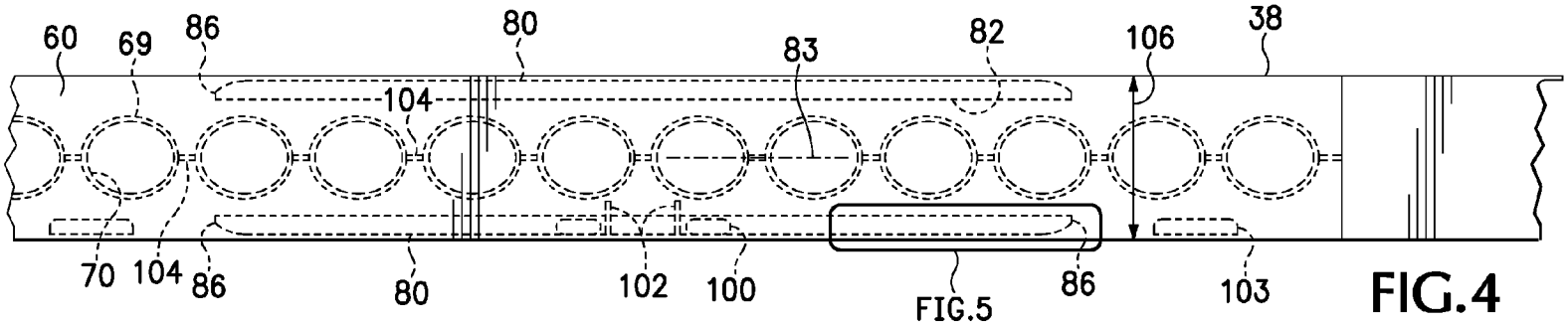
FIG. 4 is a view of the portion of a side sill shown in FIG. 3, taken from the outer side of the car unit body.

As may be seen in FIGS. 3 and 4, there are longitudinally extending reinforcements 80 inside the structure of the side sills 38, extending along both the top and the bottom of the side sills 38, centered around the middle of the length of the container well, where the central container support feet 58 are located. These reinforcements add to the stiffness and bending strength of the deep beam structure of each side sill 38, to bear the loads imposed by the adjacent ends of a pair of short containers 32 carried in the container well 34, supported by the container support members 58 located on each side sill opposite one another as shown in FIGS. 1 and 2. While a different reinforcement structure had been used previously in similar locations, it was determined that additional reinforcement of the side sills 38 was desired in order to be able to carry a pair of heavier short containers 32 in the container well 34, but it was desired to strengthen side sill 38 with a minimum of increased weight.

The reinforcements 80 disclosed herein are provided at both the top and the bottom of the channel member 62 of the side sill and are attached to the channel member 62 in such a way that the stresses developed in the reinforcements 80 are carried to a part of the channel member 62 of the side sill 38 where stresses are less than in the outermost fibers of the top flange 64 or bottom flange 66 of the channel 62.

Figure 5:
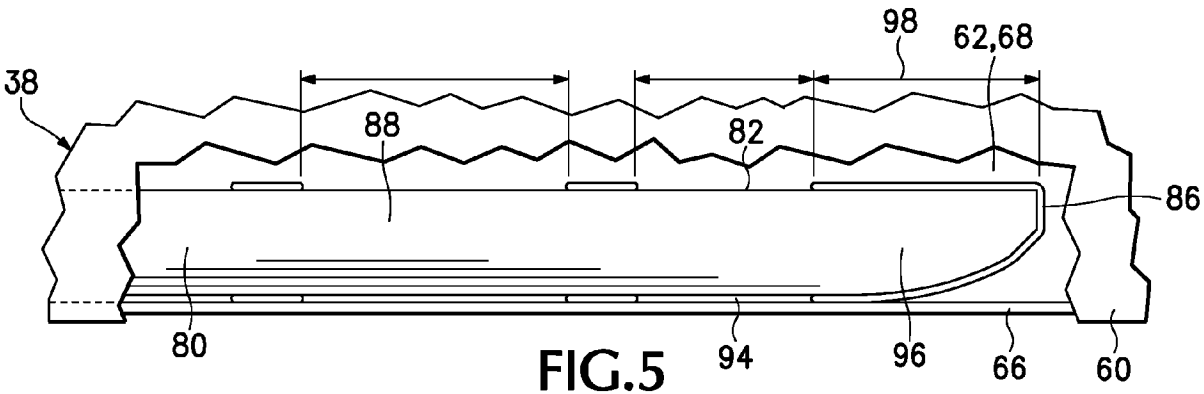
FIG. 5 is a partially cutaway detail view, at an enlarged scale, of the portion of FIG. 4 indicated by the label "FIG. 5."
Figure 8:
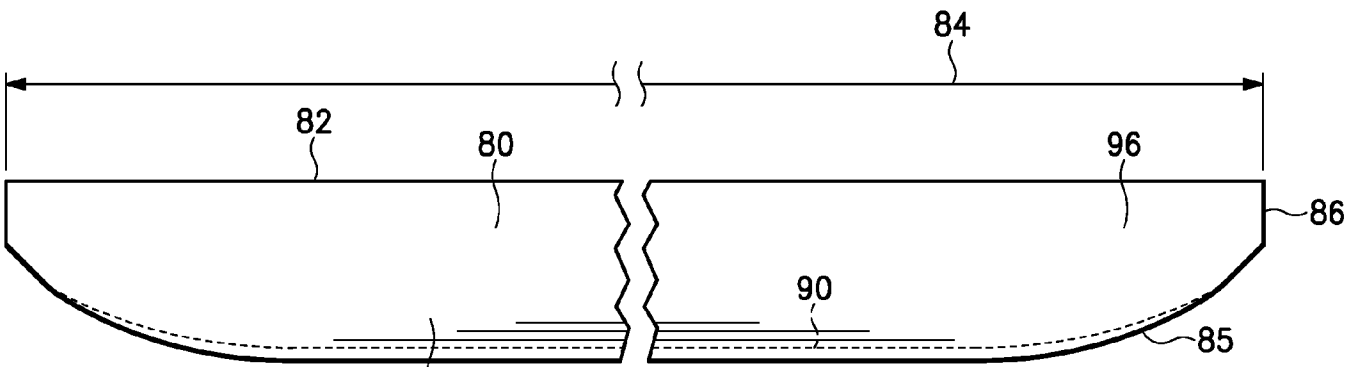
FIG. 8 is a foreshortened side elevational view of the longitudinally-extending reinforcement member shown in FIGS. 6 and 7.

As shown in FIG. 4 and FIG. 5, each reinforcement 80 has a pair of opposite extreme ends 86. Each reinforcement 80 is of plate material shown in a flat plan view in FIG. 6 and bent as shown in FIG. 7 to a side view configuration shown in FIG. 8 and shown in place in a side sill conforming to the inner surface of the channel member 62, in FIGS. 5, 9 and 10.

Each reinforcement 80 has an inner margin 82, that is, the longitudinal margin extending horizontally along the length of the side sill and located nearer to the neutral plane 83, or mid-height, of the respective side sill 38. The inner margin 82 extends over the entire length 84 of the reinforcement 80, from one extreme end 86 to the opposite extreme end 86 of the reinforcement. The reinforcement 80 has a vertical part 88 lying closely against the inner face of the web 68 of the side sill channel member 62, and a laterally extending part 90 lying closely along the top flange 64 or bottom flange 66 of the channel member 62. A bend portion 92 extends longitudinally along the reinforcement and is shaped to correspond with the bend portion 67 of the channel member 62 where the top flange 64 or bottom flange 66 extends from the web portion 68 toward the plate member 60 of the side sill structure. An outer margin 94 of the reinforcement 80 lies along the respective flange 64 or 66 of the channel member 62.

Figure 6:
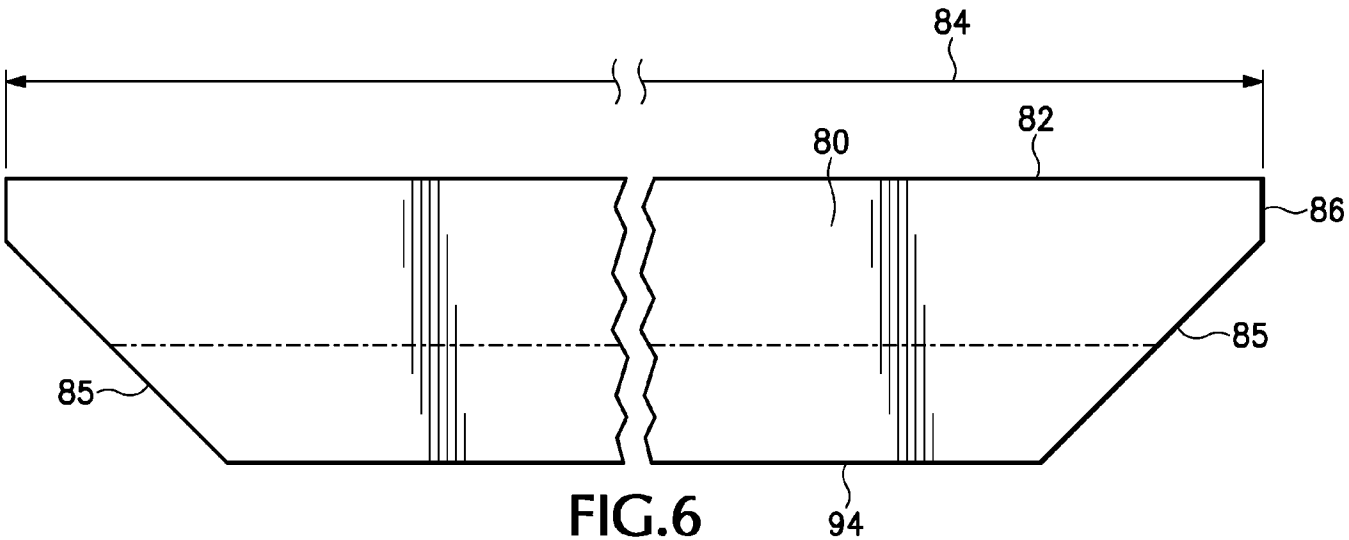
FIG. 6 is a foreshortened plan view of a longitudinally-extending reinforcement member of the side sill shown in FIGS. 3 and 4, in a flat layout form, prior to being bent into the shape illustrated in FIG. 5.
Figure 7:
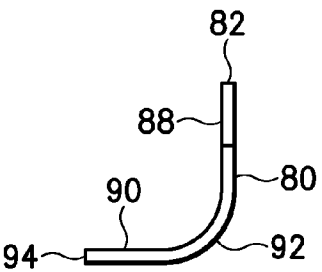
FIG. 7 is an end view, at an enlarged scale, of the longitudinally-extending reinforcement member shown in FIG. 6, bent to the shape which it has when in place in a side sill.

As may be seen in FIG. 6, the plate material of which the reinforcement 80 is formed is tapered over a portion 85 extending from each extreme end 86 toward the middle of the length of the reinforcement, so that the outer margin 94, along the laterally-extending portion 90 of the reinforcement 80, is shorter in length than the inner margin 82. The outer margin 94 thus extends a shorter distance away from the middle of the length of the side sill 38 and away from the location of the mid-length container support structures 58, toward each end of the side sill 38. The outer margin 94 is parallel with, but may be spaced apart from, the adjacent margin of the channel member 62 and the flat plate 60.

Figure 9:
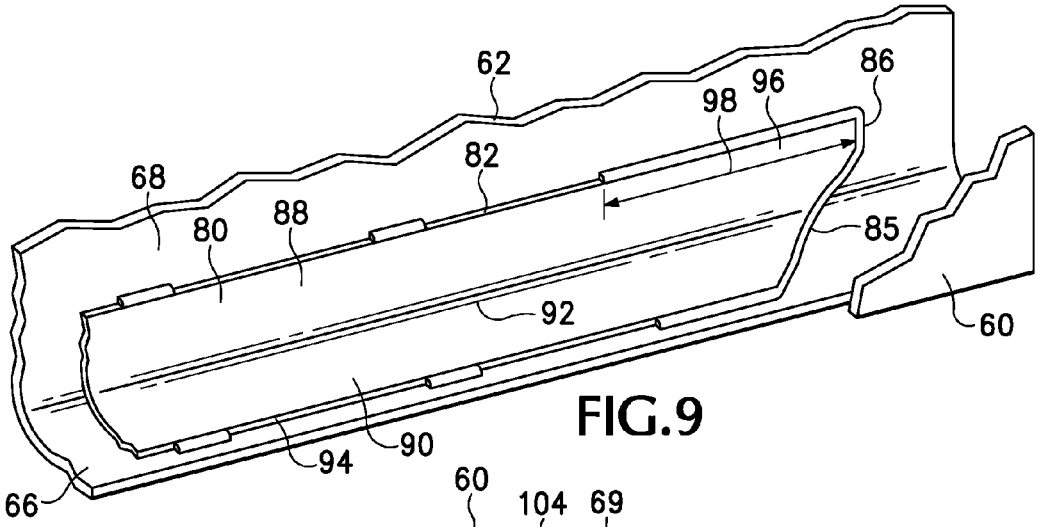
FIG. 9 is a partially cutaway isometric view, at an enlarged scale, of the portion of the side sill indicated by the label "FIG. 5" in FIG. 4.
Figure 10:
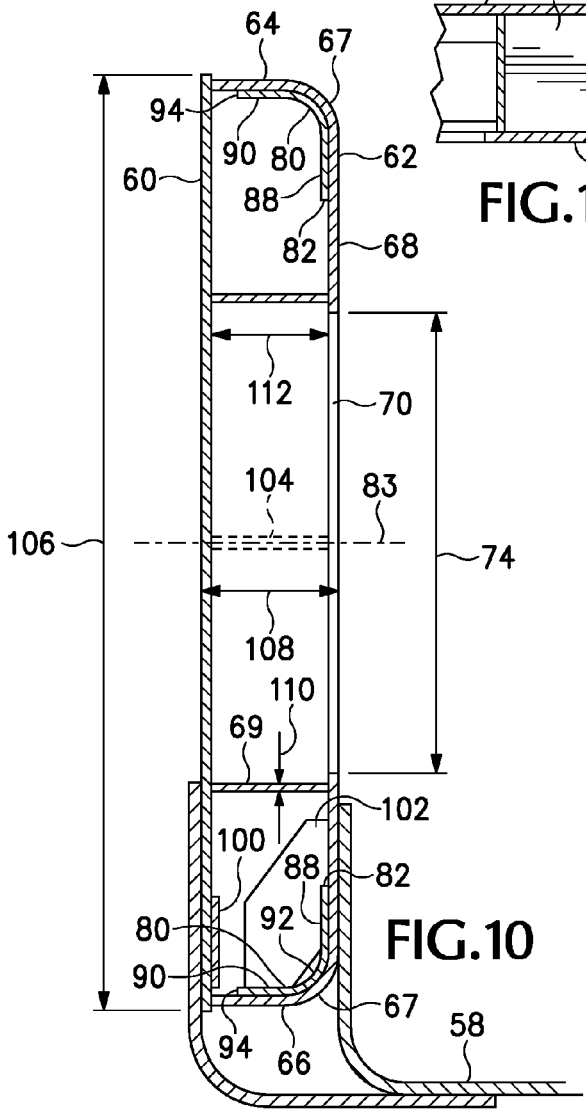
FIG. 10 is a sectional view taken along line 10-10 of FIG. 3, at an enlarged scale.

As shown in FIGS. 5 and 9, an end portion 96 of each reinforcement is welded to the inner surface of the channel member 62 along a part of the inner margin 82, the extreme end 86, the divergent margin of the tapered portion 85, and a portion of the outer margin 94, for a predetermined short distance 98, for example ten inches, from the extreme end 86 of the reinforcement. The divergent margin of the tapered portion 85 of the reinforcements 80 is welded to the adjacent surfaces of the web 68, the bend 67, and the respective flange 64 or 66, and an adjacent short portion of the outer margin 94 may also be welded to the respective flange, to a point opposite the end of the weld joint between the inner margin 82 and the web portion 68. The inner and outer margins 82 and 94 of the reinforcement 80 may be skip welded to the channel member 62 over the remainder of the length 84 of the reinforcement 80, from one end portion 96 to the opposite end portion 96, so that stresses can be carried away from the mid-length portion of the side sill 38 through the reinforcement 80 to the two end portions 96 of the reinforcement. The forces carried by the reinforcement 80 are thus carried into the web 68 of the channel member 62 at a location closer to the neutral bending 83 plane of the side sill 38 than the flange 64 or flange 66 of the channel member 62.

The stresses carried by the reinforcement 80 from mid-length of the container well 34 to the side sill channel member 62 are thus applied to the web 68 of the channel member 62 at a location where the web 68 is not exposed to maximum stresses, and where transfer of those stresses from the reinforcement 80 into the web 68 of the side sill channel 62 will not overload the material of the web 68. By tapering the end portions of the reinforcement 80 the stresses developed in the reinforcement 80 near the mid-length portion of the side sill 38 are directed from the outer margin 94 of the reinforcement 80 to the extreme end portions 86 where they are attached to the web 68 of the channel 62. As a result, the reinforcement 80 does not need to extend as far along either the top flange 64 or bottom flange 66 to reach a location where the forces carried by the reinforcement 80 could be transferred to the channel member 62 without overloading either the top flange 64 or the bottom flange 66 at the point of such attachment. The reinforcement 80 is thus able to be made shorter, and thus adds less weight in the side sill 38 than if it extended further along the top or bottom flange 64 or 66.

Additional reinforcing plates 100 may be attached to the inner surface of the side sill plate member 60, adjacent the location where the central container support member 58 is attached to the bottom of the side sill 38. Transversely oriented reinforcement plates 102 may be provided in the bottom portion of the side sill 38, aligned with the ends of the mid-length container support structure 58.

Figure 11:
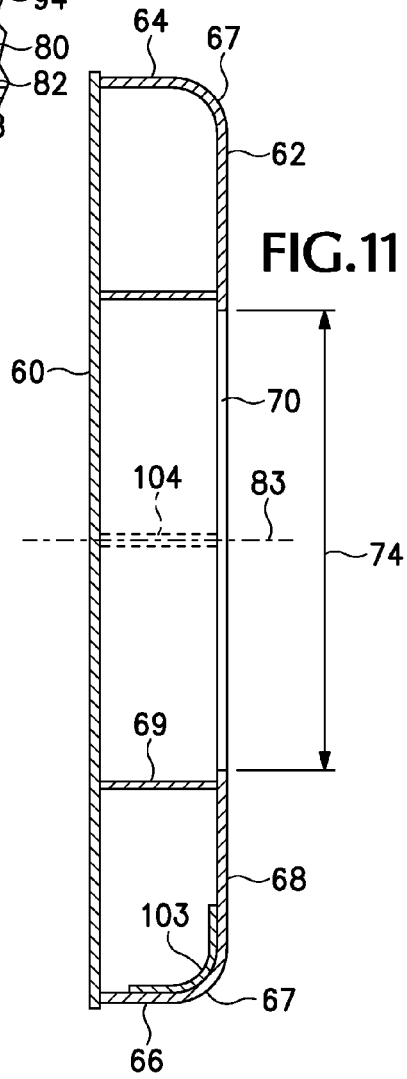
FIG. 11 is a sectional view taken along line 11-11 of FIG. 3, at an enlarged scale.

A smaller reinforcement 103, shown in FIGS. 3, 4, and 11, may be attached to the channel member 62 along the bend 67 and a portion of the web 68 and the bottom flange 66 at a location between each end of the side sill and the respective extreme end 86 of the reinforcement 80.

Figure 12:
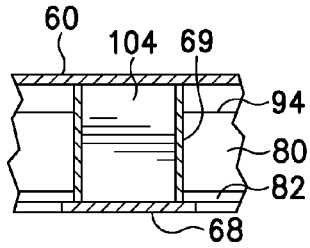
FIG. 12 is a sectional detail view taken in the direction indicated by the line 12-12 in FIG. 3.

As may be seen in FIG. 12, horizontal plates 104 may be provided between adjacent ones of the reinforcing tubes welded to the reinforcing tubes 69 and to the web 68, to provide local support for the web 68 of the channel 62 along the length of the side sills 38.

In one satisfactory sequence of construction the reinforcements 80 are welded to the inner surface of the channel member 62. The short elliptical tubes 69 are then welded to the inside of the web 68 of the channel 62, in positions aligned concentrically with the holes 70, whose edges may overhang into the tubes 69 a small distance, and the plates 104 are installed between tubes 69. Thereafter, the flanges 64 and 66 of channel 62 are welded to the plate 60, and the other ends of the tubes 69 are welded to the plate 60, as best shown in FIGS. 4 and 7. This sequence of assembly gives convenient access to the interior of the tubes 69 for the welding operation, as the plate 60 is usually not provided with openings corresponding to the holes 70, since a continuous flat surface is usually desirable on the outside of the side sills 38.

In one embodiment of the side sill 38 the outer plate 60 may be of steel of about 5/16 inch in thickness, and the channel 62 may be of steel plate having a thickness of about 11/32 inch, for a car unit 24 intended to carry a pair of 20-foot containers 32 between the side sills 38. An exemplary side sill 38 of this design may have a depth 106 of about 42 inches, and a width 108 of about 6 inches.

The cylindrical tubes 69, in one embodiment of the side sills 38, are constructed by rolling rectangular pieces of steel having a thickness 110 of about 3/16 inch into an elliptical ring shape, the butt ends being welded together to complete the tube. The length 112 of the tubes 69 is about 6 inches, less the combined thicknesses of the plate 60 and channel 62, or 5 11/32 inches. The weight of each of the tubes 69 is thus about 20.6 pounds, and is thus less than the weight of the material removed from the channel 62 in forming the hole 70.

In this case, the total weight of the set of reinforcements 80 and the set of smaller reinforcements 103 for a container car unit 24 is only about 650 pounds greater than the previously used side sill reinforcements. Thus the thin-walled side sills 38 as disclosed herein possess increased strength sufficient to support a pair of short containers 32 carried end-to-end in the container well 34 with a total of about 14 tons greater weight, with only a minimum increase of car body weight beyond that of a car unit designed to carry a pair of significantly lighter containers end-to-end in the container well 34.

The terms and expressions which have been employed in the foregoing specification are used therein as terms of description and not of limitation, and there is no intention in the use of such terms and expressions of excluding equivalents of the features shown and described or portions thereof, it being recognized that the scope of the invention is defined and limited only by the claims which follow.

What is claimed is:

1. A side sill for a body of a railroad freight car defining a container well intended for carrying intermodal freight containers, the side sill comprising:

(a) a deep, relatively narrow, elongate beam structure including a longitudinally-extending channel member having a vertical web, a laterally extending top flange, and a laterally extending bottom flange, the beam structure having a pair of opposite ends and including a mid-length portion located centrally along a length of the container well;

(b) a plate extending parallel with the vertical web of the channel member, the top flange and the bottom flange of the channel member being attached to the plate; and (c) an elongate longitudinally-extending reinforcement extending within the beam structure and through the mid-length portion of the beam structure, the reinforcement including a laterally-extending portion adjacent a respective laterally-extending flange of the channel member and a vertical portion adjacent the web portion of the channel member, the laterally-extending portion of the reinforcement being interconnected with the vertical portion of the reinforcement through a bend portion of the reinforcement, and the reinforcement having a pair of opposite end portions, each of the end portions of the reinforcement being located between the mid-length portion of the beam structure and a respective end of the container well, and the vertical portion of the reinforcement including an extreme end of the reinforcement, the extreme end being fastened to the web of the channel member and extending longitudinally further from the mid-length portion of the beam structure than does any part of the laterally-extending portion of the respective end portion of the reinforcement.

2. The side sill of claim 1 wherein each of the flanges of the channel member is interconnected with the web of the channel member through a respective longitudinally extending bend in the channel member.

3. The side sill of claim 1 wherein the channel member is formed of plate metal and includes a respective bend extending longitudinally therealong interconnecting each laterally extending flange with the vertical web, and wherein the bend portion of the reinforcement conforms to and lies along the respective bend of the channel member.

4. The side sill of claim 1 wherein the reinforcement lies closely alongside and generally in contact against the web and the respective the laterally-extending flange of the channel member.

5. The side sill of claim 1 wherein each end portion of the reinforcement is tapered from a widest part including the laterally-extending portion of the reinforcement to a narrowest part thereof defining the respective extreme end of the reinforcement, the narrowest part being fastened to the web of the channel member.

6. The side sill of claim 1 wherein the opposite end portions of the reinforcement include the vertical portions of the reinforcement and are tapered to a narrowest part that is located along an inner margin of the reinforcement.

7. The side sill of claim 6 wherein the inner margin of each end portion of the reinforcement is welded to the vertical web of the channel member.

8. The side sill of claim 1 wherein at least one of the end portions of the reinforcement is tapered and an inner margin and a divergent margin of each tapered end portion of the reinforcement are welded to the channel member throughout a predetermined limited distance from the respective extreme end of the reinforcement, and wherein the inner margin and an outer margin of the reinforcement are skip welded to the web and to a respective laterally-extending flange of the channel member over an intermediate portion of the reinforcement.

9. The side sill of claim 1 wherein one of the end portions of the reinforcement is attached to the web of the channel member at a greater distance from a mid-length part of the container well than the distance from the mid-length part of the container well to any point of attachment of the reinforcement to the respective laterally-extending flange of the channel.

10. An improved body for a railroad freight car having a pair of side sills connected to body bolsters pivotally supported on trucks and adapted to support at least one container in a container well between the side sills, comprising:

(a) a pair of side sills, each including:

(i) a metal plate;

(ii) a metal channel member extending longitudinally of the side sill and having a top flange, a bottom flange, and a web, the top flange and bottom flange being directed toward and welded to the plate;

(iii) a plurality of tubes spaced apart from one another longitudinally of the side sill and welded to the plate and to the web of the channel member, one of the plate and the web of the channel member defining a plurality of apart-spaced openings therein aligned with the tubes, with each of the tubes surrounding a respective one of the openings; and (iv) a reinforcement having a vertical portion attached to the web of the channel and a laterally-extending portion attached to one of the flanges of the channel, the vertical portion and the laterally-extending portion being interconnected with each other, and the reinforcement being tapered from a greatest width in a longitudinally middle portion thereof to a narrowest portion at an outer end of the vertical portion, and the outer end of the vertical portion being securely fastened to the web of the channel;

(b) a truss assembly interconnecting respective lower portions of the side sills and;

(c) a container supporting foot secured to a respective lower portion of each side sill in a mid-length portion of the container will, the container supporting foot being adapted to engage and support a container in the container well.

11. A side sill for a body of a railroad freight car adapted to support at least one container in a container well between a pair of the side sills, the side sill comprising:

(a) a vertically aligned, longitudinally extending metal plate;

(b) a metal channel member extending along the plate and including a vertically aligned web portion and a pair of laterally extending flange portions fixedly interconnected with the plate and, in combination with the plate, defining a box beam having a height and having a width, defined by the laterally-extending flange portions, that is smaller than the height;

(c) a plurality of stiffening tubes extending from the plate to the web portion of the channel member, each of the tubes extending generally transversely of the side sill and having a first end welded to the plate and a second end welded to the web portion of the channel member, and one of plate and the channel member defining a plurality of openings therein each communicating with the interior of a respective one of the tubes, each tube having a length and a largest dimension perpendicular to the length; and (d) an elongate reinforcement member extending along the web portion and a respective one of the flange portions of the channel member in a mid-length portion of the side sill, the reinforcement having a pair of opposite extreme ends defined by a vertical portion of the reinforcement, a laterally-extending portion of the reinforcement being shorter than the vertical portion and being located between the opposite extreme ends, and wherein end portions of the reinforcement member adjacent and within a predetermined distance from the opposite extreme ends are joined to the web portion of the channel member, and portions of the reinforcement member located between the end portions are located closely adjacent to the channel member, whereby the reinforcement carries stresses, applied to a mid-length portion of the side sill by a container supported in the container well, away from the respective flange portion of the channel member to a portion of the web portion of the channel member at a distance away from the mid-length portion of the side sill.

12. The side sill of claim 11 wherein respective margins of the reinforcement are skip welded to the web portion and the respective laterally extending flange portion of the channel member at locations between the end portions of the reinforcement.

* * * * *